United States Patent [19]

Fassbender et al.

[11] 4,189,983

[45] Feb. 26, 1980

[54] SERVOMOTOR PRESSURE CONTROL RESPONSIVE TO PISTON TRAVEL

[75] Inventors: Rolf Fassbender, Mutlangen; Armin Lang, Schwäbisch Gmünd-Bettringen, both of Fed. Rep. of Germany

[73] Assignee: Zahnradfabrik Friedrichshafen AG, Friedrichshafen, Fed. Rep. of Germany

[21] Appl. No.: 756,794

[22] Filed: Jan. 4, 1977

[51] Int. Cl.[2] ..... F15B 15/22

[52] U.S. Cl. ..... 91/400; 91/451

[58] Field of Search ..... 91/400, 401, 449, 451, 91/452

[56] References Cited

U.S. PATENT DOCUMENTS

| | | | |
|---|---|---|---|
| 1,046,136 | 12/1912 | Yassenoff | 91/341 R |
| 1,355,208 | 10/1920 | Bassler | 91/341 R |
| 1,969,736 | 8/1934 | Erling | 91/400 |
| 2,389,654 | 11/1945 | Van Der Werff | 91/401 |
| 3,413,895 | 12/1968 | Matthews | 91/400 |
| 3,878,763 | 4/1975 | Lang | 91/391 R |

FOREIGN PATENT DOCUMENTS

| | | | |
|---|---|---|---|
| 1926861 | 12/1970 | Fed. Rep. of Germany | 91/341 R |

*Primary Examiner*—Paul E. Maslousky
*Attorney, Agent, or Firm*—Zalkind & Shuster

[57] ABSTRACT

An arrangement in the dropping of pressure in either chamber of a double acting booster steering servomotor is provided, such pressure drop starting at a predetermined point toward the end of travel of the servomotor piston in either direction. The invention is characterized by a respective bypass valve in each chamber, spring biased to closed position, and engageable by the piston, to be opened gradually. The piston force is exerted on the bypass valves through a respective spring so as to effect the gradual opening instead of the abrupt opening effected in the prior art. Opening of the bypass valves effects connections which shunt the servopump output to the system oil tank via a differential pressure valve as taught in Lang U.S. Pat. No. 3,878,763 to prevent strong mechanical stresses on the steering linkages at the ends of steering movement. Shunt control takes place through desirably small flow lines and bypass valves which heretofore have been found to produce undesirably abrupt operation.

8 Claims, 3 Drawing Figures

SERVOMOTOR PRESSURE CONTROL RESPONSIVE TO PISTON TRAVEL

The patent to Armin Lang, U.S. Pat. No. 3,878,763, issued Apr. 22, 1975 is hereby incorporated by reference herein.

A companion application, co-pending herewith, is as follows: Fassbender and Lang, Ser. No. 756,738, filed Jan. 4, 1977, for FEED PRESSURE BYPASS VALVING FOR SERVOMOTOR.

To recapitulate, in order to be able to keep the bypass valves small, a small control flow therethrough must suffice to operate the differential pressure valve of the servopump shunt system. Accordingly, the pressure in the control line to the differential pressure valve is dropped during a relatively short travel of the respective bypass valves. The sudden loss of hydraulic pressure in prior art constructions causes the steered wheels of the vehicle to snap back from the steered direction moving the piston out of engagement with the respective bypass valve so that such bypass valve may close again causing instability, i.e., a hunting effect, The invention teaches a bypass valve construction wherein abrupt actuating is prevented and thus instability of operation is precluded as is the possibility of the piston striking the end walls of the cylinder.

A solution of this problem might be thought to be merely extending the opening travel of the bypass valve and suitable design of passage. However, the very small control current flow passing through the bypass valves makes such an arrangement impractical. The narrow flow openings would very quickly be plugged up and closed by particles of dirt in the oil.

A detailed description of the invention will now be given in conjunction with the appended drawing in which:

FIG. 1 diagrammatically illustrates the system with the particularly novel bypass valves symbolized;

The U.S. Pat. to Lang, No. 3,878,763, hereinabove incorporated by reference, shows a hydraulic steering control system which shunts or bypasses the main pump of a booster steering system as the servomotor piston approaches the end of its travel in either direction. This provides a limit of heavy hydraulic pressure exerted on the steering mechanism when the mechanism nears the end of steering motion in either direction in order to avoid damage. At such dropping of servopump pressure, manual pressure by virture of rotation of the steering wheel by an operator is brought to bear through a metering pump.

The Lang patent shows details of the hydraulic circuitry components for effecting the servopump shunting operation by way of a differential pressure operated valve which opens up a shunt path from the servopump output to the system tank responsive to opening of a respective bypass valve carried at the ends of a double acting servomotor cylinder. Respective bypass valves are engaged by the piston at a predetermined point at either end of travel thereof to effect actuation of the differential pressure operated valve.

The prior art has other patents for effecting unloading of the servopump at the end of servopiston travel or show other aspects of this technology.

Patents thought to be of particular interest, at least academically, are U.S. Pat. Nos. Jablonsky 3,047,087 issued July 31, 1962; Sheppard 3,092,083 issued June 4, 1963; Jablonsky et al 3,252,380 issued May 24, 1966; Symons et al 3,385,389 issued May 28, 1968; and Allen 3,566,749 issued Mar. 2, 1971.

The present invention differs from the Lang U.S. Pat. No. 3,878,763 in the construction of the bypass valves carried by the end walls of the servomotor cylinder by providing a reduction in the force necessary to open a bypass valve, to the point that feed pressure upstream of the bypass valve effects opening. The force reduction is effected by a respective compression spring for each bypass valve interposed between the respective servopiston faces and the bypass valves. A gradual opening force is thus effected by the servopiston wherein the conventional compression spring bias normally holding the bypass valves closed is overcome by the increasing compression in the interposed springs by virtue of compressive forces exerted thereon for a predetermined distance at the ends of the stroke. This has the effect of preventing abrupt servopump shunting wherein sudden drop of hydraulic booster pressure causes loss of steered wheel position.

Figure 1:
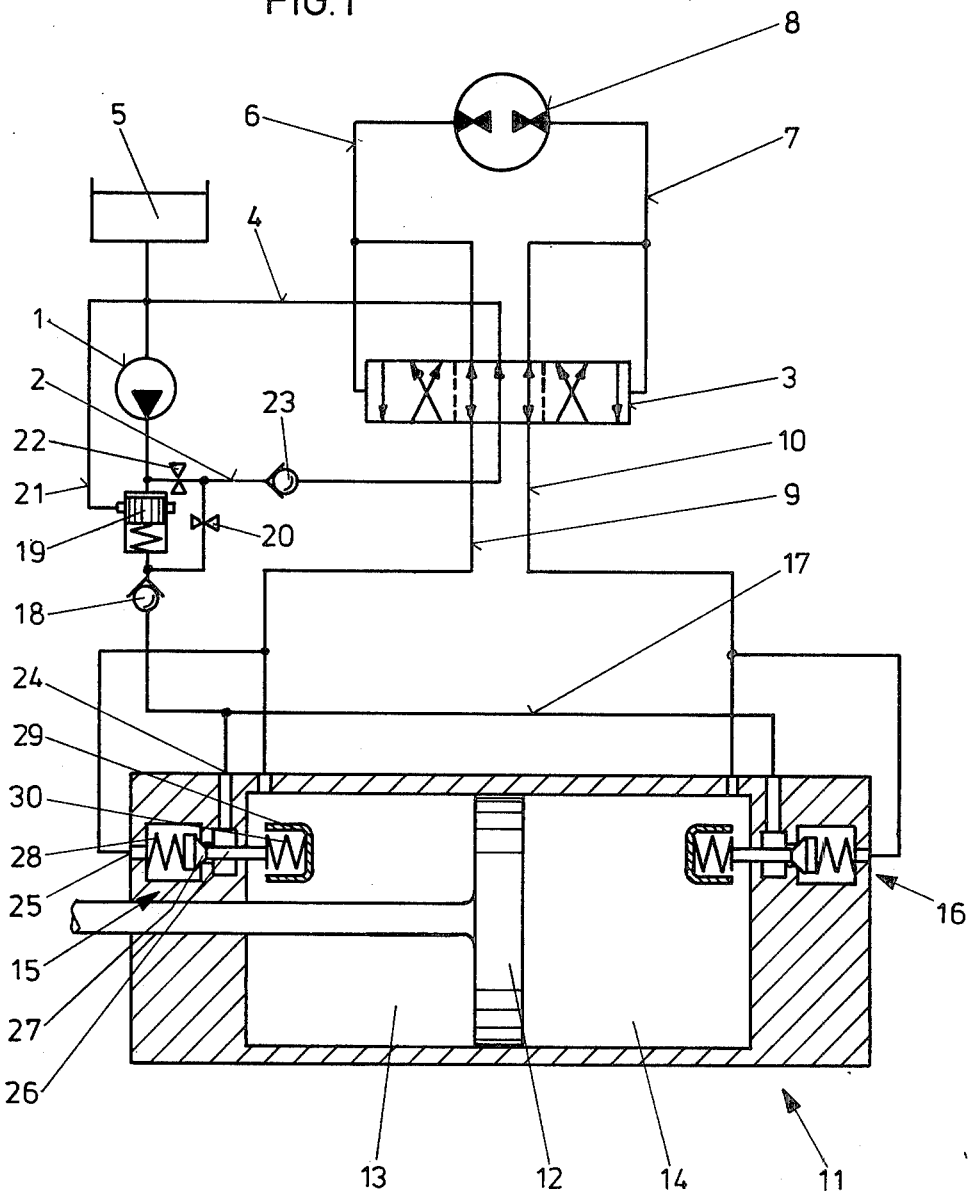

Referring to FIG. 1, the servopump 1 is shown connected with the usual steering control valve 3 via pressure feed line 2 with return line 4 connected to oil tank or reservoir 5. Steering control valve 3 connects via lines 6 and 7 with the metering pump 8 which will be understood to be manually operable by a hand steering wheel as is steering control valve 3, all of which is conventional. Steering control valve 3 connects via lines 9 and 10 with a servomotor 11 having pressure chambers 13 and 14 on opposite sides of servopiston 12.

Respective bypass valves 15 and 16 carried in the end walls of the servomotor cylinder connect via respective lines 9 and 10 with the steering control valve 3 on the downstream ends of the bypass valves and connect via a bypass pressure control line 17 through a check valve 18 to a differential pressure piston valve 19. Control line 17 will be seen to connect to the upstream ends of the bypass valves 15 and 16 and lines 9 and 10 connect for pressure and exhaust operation control to the servomotor chambers, all in the usual manner. It will be noted that the control line 17 connects to pressure feed line 2 via check valve 18 and differential pressure valve 19 which is bridged by throttle 20. A bypass line 21 connects the differential pressure valve 19 directly with the return line 4. A further throttle 22 and check valve 23 in series are connected in feed line 2 intermediate servopump 1 and steering control valve 3.

The bypass valves 15 and 16 are identical in structure and function and therefore only valve 15 need be described in detail. Control line 17 has a connection 24 for inlet pressure upstream of bypass valve 15 and line 9 has an outlet or return connection 25 downstream of bypass valve 15. Bypass valve 15 has a valve body 26 terminating in a cone valve head 27 disposed to cut off flow against a valve seat, as shown, between connections 24 and 25 by virtue of bias of spring 28. In FIG. 1 spring 28 is shown as disposed between a wall of the cylinder and the valve head 27. Pressure in control line 17 acts in the opening direction of valve head 27 against bias of spring 28. Valve body 26 projects into the pressure chamber 13 of the servomotor 11. A further compression spring 30 is carried at the end of the valve rod in a spring retainer cup 29 abuttable by servopiston 12, which retainer serves as an opening actuating element for the bypass valve 15 through compression of spring 30 as the servopiston arrives at the terminal travel of its stroke.

Figure 2:
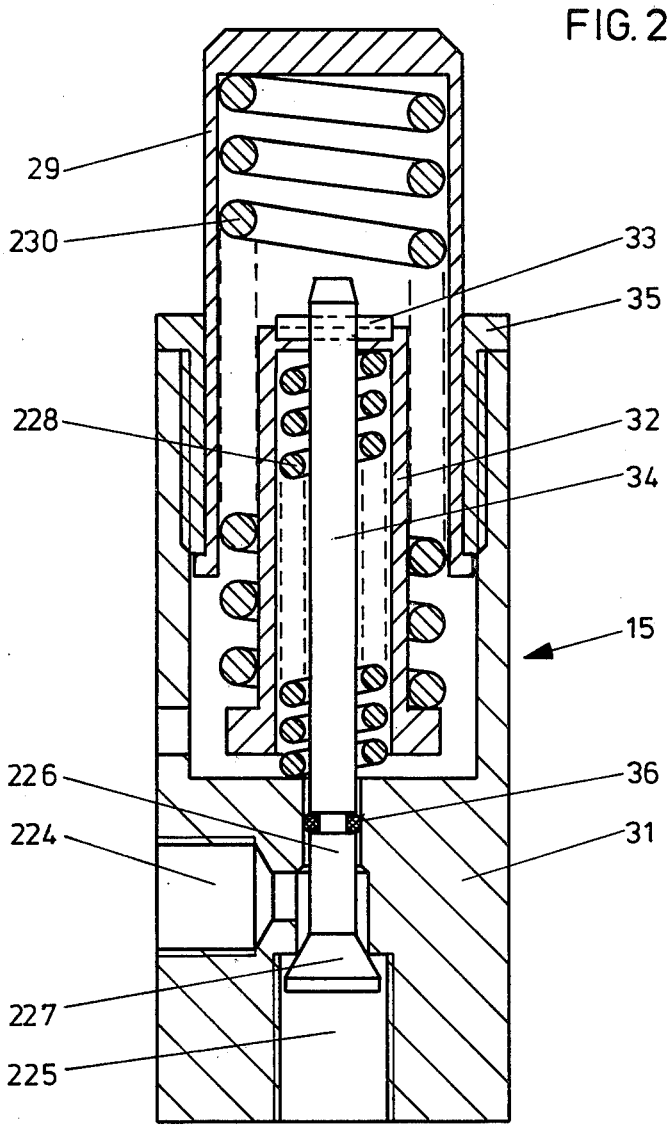
FIG. 2 is a cross section elevation of a bypass valve as used herein.

The details of construction of the bypass valves, referring to bypass valve 15, are shown in FIG. 2 wherein the same reference numerals are used to those components symbolized on FIG. 1. A housing 31 for the bypass valve may be a portion of the servomotor cylinder or it can be a threaded cartridge inserted in the end wall of the cylinder. In either case, the operating components shown in FIG. 2 would remain the same.

The conical valve head 27 which controls flow between inlet connection 24 and return connection 25 is shown as disposed for opening against the bias of spring 28 which encircles the valve rod extension 34 from valve body 26, and is retained in a spring retainer cup 32. The outer end of spring 28 abuts the bottom of the cup which is held longitudinally to the rod 34 as by a pin 33 through the rod in a manner which will be clear from the drawing. The inner end of spring 28 abuts the bottom of a bore in housing 31 for reaction support. The rod intermediate portion between valve body 26 and rod 34 is provided with a sealing washer 36 such portion being necked down. The sealing washer rides within a bore of housing 31 which provides guidance for the valve movement. The further compression spring 30 is internally guided on the exterior of the retainer cup 32 and externally guided within the spring retainer cup 29 that also serves as the operator for the bypass valve upon being engaged by the servomotor piston. Thus, spring 30 exerts a force between a radial flange at an extremity of cup 32 and the bottom of cup 29 being maintained in predetermined compression by the positioning of cup 29 via a retaining bushing 35 threaded into housing 31 and wherein the open end of cup 29 is provided with a radial flange abutting the edge of the bushing to be retained.

It will be understood that the balance of forces acting to separate conical valve head 27 from its seat, such as pressure in line 17 and compression in spring 30 with oppositely acting compression in spring 28 remains as a constant force determined by the initial stress in spring 30 dependent upon the point of retaining abutment between the flange on cup 29 and bushing 35. Such contact is maintained until the piston of the servomotor engages the outer face of cup 29. Upon engagement of piston 12 with cup 29, and continued movement of the piston, the cup 29 is moved away from support contact with bushing 35, further compressing spring 30 until it overcomes the initial compression in spring 28, a function of the length of travel of piston 12 toward the end of its stroke, reducing the force necessary to open the bypass valve 15. Ultimately, the balance of forces between the two springs becomes reduced to the point that the upstream pressure in control line 17 acting against the exposed upstream surface of conical valve head 27 is sufficient to then open the bypass valve by separation from its seat in the housing.

The end result of opening of the bypass valve 15 is the same as in the Lang U.S. Pat. No. 3,878,763, albeit certain connections and flow direction are different, but, the servopump output, i.e., feed pressure, is shunted to the tank.

In the patent, the opening of a bypass valve causes flow from the differential pressure valve via a check valve through the bypass valve to the servomotor chamber being exhausted via the steering control valve and thus to the tank. This unbalances the valve piston in the differential pressure operated valve causing flow pressure drop in the pressurized chamber by shunting servopump output. In the present invention when a bypass valve such as 15 is opened, flow takes place from the differential pressure valve 19 via check valve 18 but is directed to the upstream side of the bypass valve via bypass pressure control line 17 and inlet connection 24, to exit at return connection 25 to exhaust via steering control valve 3 to the tank. Such bypass control flow does not pass through the chamber being exhausted. Thus, the piston force acting on the dual spring arrangement reduces the force necessary to open the bypass valve 15 to the point where pressure in line 17 coacts with the piston force to effect bypass opening. The operation of bypass valve 16 is identical.

In either case, the unbalance of the differential pressure valve opens it and in the present invention, as in the Lang patent, shunts the servopump output via line 21 to the tank (line 20 in the Lang patent).

A further distinction is noted between the present invention and the Lang patent in that in the patent the bypass valves must be opened by servomotor piston force against heavy pressure albeit throttled down from straight output pressure. This is believed to increase the abruptness of opening. However, such condition is precluded in the present invention by directing that outlet pressure to aid in the opening of the bypass valves via throttle 20.

The opening of the bypass valves is dependent on the distance of piston travel at the end of a stroke. See FIG. 3.

Figure 3:
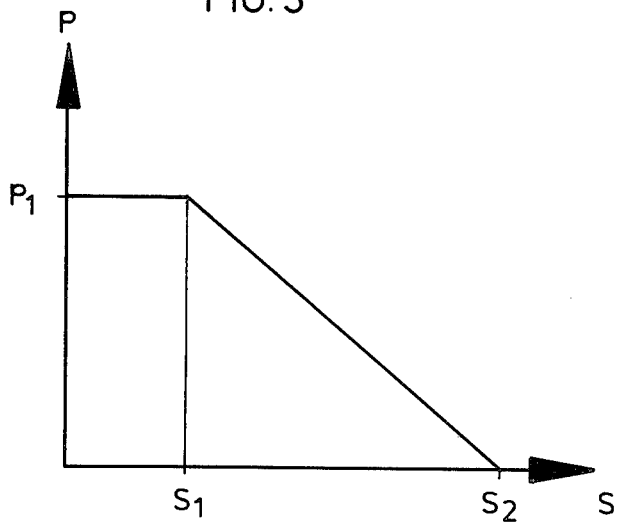
FIG. 3 is a graph showing servomotor chamber pressure as a function of servomotor piston travel distance at the end of a stroke.

The improved control effect of the bypass valves is shown graphically in FIG. 3 wherein the abscissa S represents the piston travel at the end of a stroke from $S_1$ to $S_2$ and the ordinate P represents the pressure existing along the path or distance of such terminal travel. Thus, up to the point $S_1$, at which the piston 12 touches the actuating element or cup 29, the pressure in a cylinder chamber remains constant at $P_1$. However, upon engagement and the starting to open of the bypass valve, the chamber pressure gradually drops down to zero as the piston progresses in its movement to point $S_2$. Abrupt booster pressure drop is avoided.

Flow takes place from control line 17 via return connection 25 and line 9 to tank 5 so that the servopump pressure is shunted to the tank via the differential pressure operation in valve 19 all as described in Lang U.S. Pat. No. 3,878,763. Moreover, the synchronization between manual operation of the steering wheel and the servomotor is fully maintained since the pressure oil cannot escape on the pressure side of the servomotor, for example, from pressure chamber 14, in this instance, since the bypass valve description has referred to bypass valve 15. Upon shunting of the servopump, manual power steering via metering pump path can then take place in the usual manner.

The effect and advantage of the bypass valves of the invention resides in the fact that pressure drop in the pressurized chamber being made a function of servomotor piston travel there is no sudden reduction in booster steering power and thereby a reverse swinging of the steered wheels or a "bouncing back" effect with attending instability is avoided. Further, quiet operation results and the invention can be readily made a matter of design by selection of spring rate for the spring 30 to adapt it to a large variety of vehicles.

We claim:

1. In a booster steering system of the kind described and which comprises a servomotor having a piston with means effecting feed pressure thereto and including feed pressure bypass means to relieve pressure from said servomotor by bypassing feed pressure to a sump responsive to travel of the servomotor piston toward the end of a stroke and said bypass means comprising bypass valve means operable by piston travel, and including means for effecting throttled feed pressure in the opening direction of said bypass valve means;

the improvement which comprises: said bypass valve means comprising a bypass valve construction having a valve head with a resilient closure bias means and a resilient opening means disposed to be increasingly compressed by piston travel toward the end of a stroke to oppose the resilient closure bias means for effecting gradual opening force on said valve head to the point where said throttled feed pressure can effect opening thereof to prevent abrupt pressure drop in said servomotor by gradually reducing the force needed to overcome the closure bias means.

2. In a booster steering system as set forth in claim 1, said resilient closure bias means comprising a bias compression closure spring (28) disposed and arranged to effect normal closure;

said resilient opening means comprising a spring (30) disposed and arranged to be compressed by piston travel to counteract the bias of said closure spring for reducing the force required to open said bypass valve means.

3. In a booster steering system as set forth in claim 1, wherein said bypass valve head comprises a conical valve head having an upstream portion exposed to said feed pressure.

4. In a booster steering system having a servo-pump effecting servomotor feed pressure and a piston in said servomotor;

means for gradual dropping of feed pressure responsive to piston distance travel toward the end of a stroke comprising normally closed bypass valve means (15);

actuating means (30) for said bypass valve means arranged to have piston force exerted thereon with increasing force as a function of piston distance travel toward the end of a piston stroke to effect a gradual reduction in force required for opening said bypass valves;

said bypass valve means comprising a housing (31) and a valve having a conical head (27) and an elongated rod-like body (26, 34);

a valve seat in said housing wherein said valve head engages said valve seat with a portion exposed to upstream flow so as to be acted upon in an opening direction by fluid pressure;

said housing having an inlet connection upstream of said valve head and an outlet connection downstream thereof;

a closure bias spring encompassing said elongated body constructed and arranged to bias said valve against said valve seat;

a cup member surrounding said closure spring and having a radial flange;

said actuating means comprising a spring surrounding said cup and supported at one end on said flange;

a cup surrounding said actuating spring for support thereof at the other end and being slidable in said housing for compression of said actuating spring against the closing force of said closure spring;

said latter cup and housing having engaging means to retain said latter cup in an initial position relative to said housing and said latter cup extending outwardly of said housing so as to be engageable by the moving piston of a servomotor.

5. In a booster steering system as set forth in claim 4, wherein said means providing engagement between said latter cup and said housing comprises a bushing threadedly secured in said housing;

said latter cup having a radial flange and said bushing having a radial edge engageable by said latter flange.

6. In a booster steering system as set forth in claim 4, said housing having a bore;

said valve body having a sealing washer upstream of said valve head and sealingly and slideably engageable in said bore and being disposed to preclude fluid flow to said springs from said inlet connection.

7. In a booster steering system of the kind described having a servomotor cylinder having pressure chambers and a piston therebetween and feed pressure means and wherein said pressure chambers are provided with respective normally closed bypass valves comprising respective closure bias springs for biasing said bypass valves to closed position and also having feed pressure means pressurizing said pressure chambers and including valve means actuable for dropping feed pressure responsive to opening of a bypass valve;

the improvement which comprises:

an actuating spring (30) for each said bypass valve disposed to be compressed by piston engagement toward the end of a piston stroke against the closing force of the respective bias spring to gradually reduce the force required to open the respective bypass valve;

means (17, 18, 20, 22) for directing throttled fluid pressure in the opening direction of said bypass valves acting to effect opening thereof upon predetermined reduced opening force whereby pressure drop in either pressure chamber is a function of the piston travel distance toward the end of a stroke to avoid abrupt opening of the respective bypass valve.

8. In a booster steering system of the kind described having a servomotor cylinder having a pressure chamber and a piston and a feed pressure means;

the improvement which comprises:

said pressure chamber being provided with a normally closed bypass valve comprising a bias spring (28) for resiliently biasing said bypass valve to closed position;

an actuating spring (30) for said bypass valve disposed to be compressed by piston engagement toward the end of a piston stroke against the closing force of the respective bias spring to gradually reduce the force required to open the respective bypass valve;

pressure feed connection means upstream of said bypass valve for directing throttled fluid pressure in the opening direction of said bypass valve and acting to effect opening bias thereon and to open said bypass valve upon predetermined reduced opening force effected by progressive compression of said actuating spring whereby pressure drop in said chamber is a function of the piston travel distance toward the end of a stroke to avoid abrupt opening of said bypass valve.

* * * * *